United States Patent [19]

Stich

[11] 4,151,776

[45] May 1, 1979

[54] ELECTRONIC PICKUP SYSTEM FOR STRINGED MUSICAL INSTRUMENT

[75] Inventor: Willi Lorenz Stich, Nashville, Tenn.

[73] Assignee: Norlin Industries, Inc., Lincolnwood, Ill.

[21] Appl. No.: 588,688

[22] Filed: Jun. 20, 1975

[51] Int. Cl.[2] ..... G10H 3/00

[52] U.S. Cl. ..... 84/1.16; 84/1.15

[58] Field of Search ..... 84/1.15, 1.16, DIG. 1, 84/DIG. 24, DIG. 27; 179/1 M

[56] References Cited

U.S. PATENT DOCUMENTS

| | | | |
|---|---|---|---|
| Re. 25,728 | 2/1965 | Freeman | 84/1.16 |
| 2,817,261 | 12/1957 | Fender | 84/1.16 |
| 3,192,304 | 6/1965 | Rizzutti | 84/1.16 |
| 3,196,729 | 7/1965 | Brans et al. | 84/DIG. 1 |
| 3,478,158 | 11/1969 | Trainor | 84/1.16 |
| 3,544,696 | 12/1970 | Broussard | 84/1.15 |
| 3,668,295 | 6/1972 | Broussard | 84/1.15 |
| 3,742,113 | 6/1973 | Cohen | 84/1.16 |
| 3,869,952 | 3/1975 | Rowe | 84/1.16 |
| 3,911,777 | 10/1975 | Rendell | 84/1.16 |
| 3,915,048 | 10/1975 | Stick | 84/1.15 |

FOREIGN PATENT DOCUMENTS

| | | | |
|---|---|---|---|
| 1213712 | 3/1966 | Fed. Rep. of Germany | 84/1.16 |
| 2139481 | 2/1973 | Fed. Rep. of Germany | 84/DIG. 27 |

*Primary Examiner*—Edith S. Jackmon

*Attorney, Agent, or Firm*—Ronald J. Kransdorf

[57] ABSTRACT

This invention relates to an electronic pickup system for a stringed musical instrument. The system includes three pickup coils positioned under the instrument strings and oriented one behind the other along the length of the strings. Each of the coils is wound around a coil form in a predetermined direction and has a selectively poled magnet passing through its center. The coils are selectively electrically connected, at least two at a time, to each other and to the system output. The manner in which the coils may be connected include connecting any two of the coils in a maner such that signals induced in the coils as a result of string vibration are in phase, at at least selected frequencies, and thus additive. The coils normally are also connected in a manner such that noise signals induced in the coils are out of phase and therefore cancel. It is also possible to connect both of the outer coils to the center coil so that signals induced in each pair of coils as a result of string vibration are additive and noise signals induced in each pair of coils cancel. When the coils are connected in this manner, the outputs from both of the outer coils may be connected to the same output or, if a stereo output is desired, the outputs from each of the coils may be connected to a separate output channel. The spacing of the coils which are connected together may be selected so that signals induced in the coils as a result of string vibration are in phase and thus additive for selecting frequencies and are out of phase and are thus cancelled for other selected frequencies. The frequencies at which the signals are in phase and the frequencies at which the signals are out of phase may be altered by altering the spacing between the coils. The magnitude of the signal induced in one or more of the coils may also be modified by raising or lowering the coil or by other suitable means.

17 Claims, 4 Drawing Figures

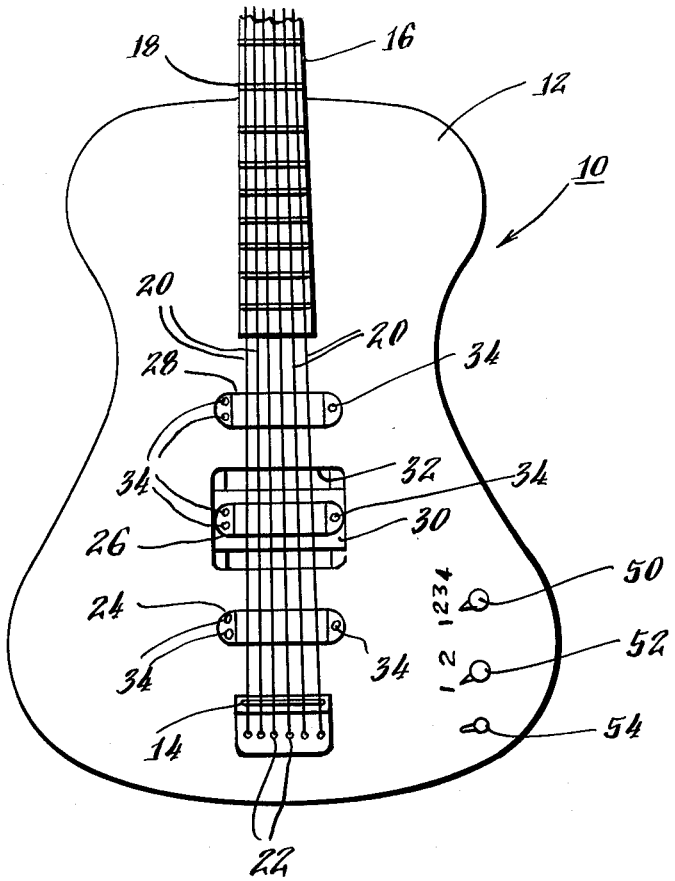
Fig. 1.
Fig. 2.
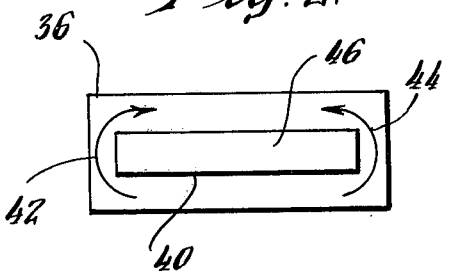
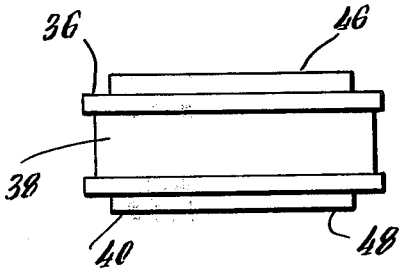
Fig. 3.
Fig. 4.
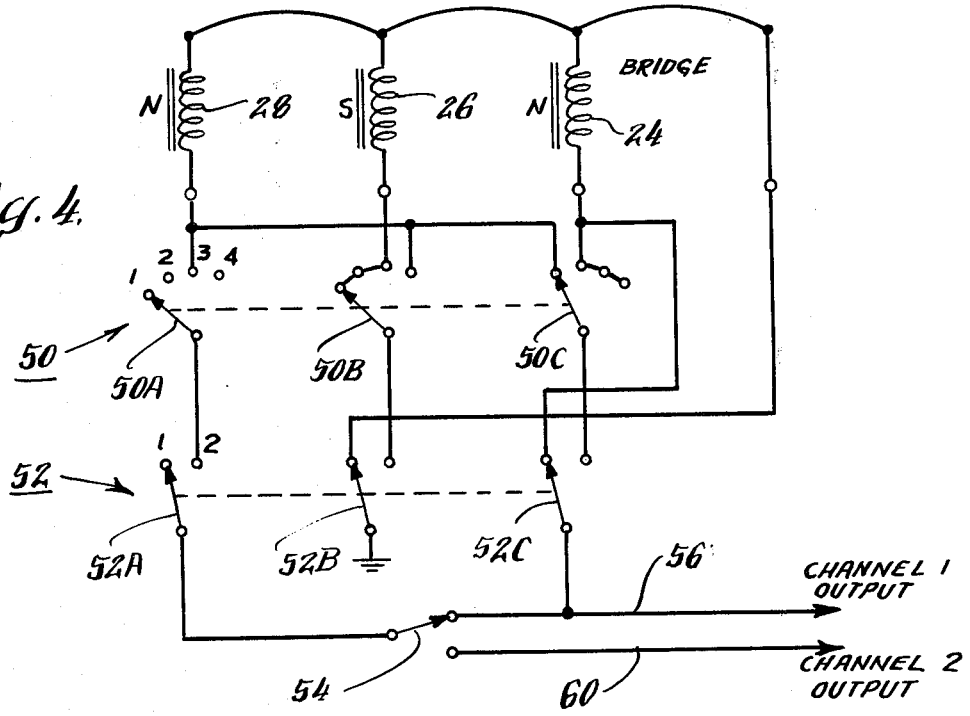

ELECTRONIC PICKUP SYSTEM FOR STRINGED MUSICAL INSTRUMENT

BACKGROUND

Field of the Invention

This invention relates to electronic pickup systems for stringed musical instruments.

The Prior Art

In electronic stringed musical instruments, such as electric guitars, one or more electronic pickup coils are positioned under the strings of the instrument. As the strings vibrate, variations are caused in the magnetic field produced by a permanent magnet passing through the coil, these variations in magnetic field causing predetermined currents to be generated in the coils. However, stray electromagnetic energy may also cause currents to be induced in the pickup coils resulting in noise signal outputs. To eliminate such noise signals from the pickup output, two pickup coils positioned adjacent to each other, but wound in opposite directions, have been connected in series in most existing pickup systems, noise signals induced in these coils being out of phase with each other and thus cancelling. By poling the magnets of these coils in opposite directions, an additional 180° phase shift is introduced for signals induced in the coils as a result of string vibration, causing these signals to be in phase and thus additive. Two-coil systems of the type indicated above normally have their coils positioned in one of three ways:

1. A single two-coil pickup has been fixedly positioned a selected distance from the instrument bridge.
2. A single two-coil pickup has been mounted for movement parallel to the instrument's strings toward and away from the instrument bridge.
3. Two separate two-coil pickups (a total of four coils) are utilized, one pair of coils being positioned near the instrument bridge and the other pair of coils being positioned closer to the instrument fingerboard.

The problem with the first configuration indicated above results from the fact that the sound obtained from the pickup varies as to the position of the pickup is changed from a position near the bridge of the instrument back toward the instrument soundboard, the sound being strong in the high frequency or treble range when the pickup coils are near the bridge, and the frequency at which the signal is strongest becoming increasingly lower as the pickup is moved back from the bridge toward the fingerboard. Thus, with a single fixedly position two-coil pickup, only a single sound can be obtained from the instrument.

The second configuration indicated above offers a partial solution to this problem by permitting the coil to be positioned in order to achieve a desired sound. However, regardless of where the pickup coils are positioned, only one sound can be obtained at any given time and it is difficult for the musician to reposition the pickup in the middle of a performance in order to achieve a desired change in sound. A further limitation on this configuration, and on configuration one, is that neither offers a stereo capability.

Configuration three above overcomes some of these problems in that, with suitable switching, the musician can obtain a sound heavy in treble frequencies, a sound heavy in bass frequencies, or can mix the two either on a single output or on separate outputs to obtain a stereo effect. This configuration however requires the use of four coils and is therefore relatively expensive. Further, it is limited in that it can only provide a maximum of three different sounds.

From the above it is apparent that a need exists for an electronic pickup system which permits the musician to obtain a variety of sounds from the instrument, to change sounds quickly and easily, and to obtain stereo output if desired. Such a system should also be adapted to cancel any noise signals induced in the pickup coils. Further, the flexibility and capabilities indicated above should be achieved utilizing a minimum of hardware, the resulting system being relatively simple and inexpensive.

SUMMARY OF THE PRESENT INVENTION

In accordance with the above, this invention provides an electronic pickup system for a stringed musical instrument, the system including first, second and third pickup coils positioned under the strings of the instrument, the coils being oriented one behind the other along the length of the strings and each coil being wound on a coil form in a predetermined direction and having a selectively poled magnet passing through its center. A means is provided for selectively electrically connecting the coils, at least two at a time, to each other and to a system output. The means for selectively electrically connecting preferably includes means for connecting at least two of the coils in a manner such that signals induced in the coils as a result of string vibration are in phase for at least selected frequencies, and thus additive, while noise signals induced in the coils are out of phase and thus cancel. With the center coil as the second coil, the means for selectively electrically connecting includes means for connecting the first and second coils and means for connecting the third and second coils, both in a manner such that signals induced in the two coils as a result of string vibration are in phase for at least selected frequencies and are thus additive while noise signals induced in the coils of each set are out of phase and cancel. The outputs from the first and third coils may be connected to a single output channel or two output channels may be provided with the output from the first coil being connected to one of the channels and the output from the third coil to the other channel, a stereo output thus being obtained. Additional variations in sound output may be obtained by spacing the coils in a manner such that signals induced in the coils as a result of string vibration are in phase at selected frequencies and out of phase at other selected frequencies. By providing means for varying the spacing between at least selected ones of the coils, the frequencies at which the induced signals are in phase and out of phase may be varied. Still further sound variations may be obtained through the use of a means for reducing or eliminating the inducing of signals resulting from string vibration in at least one of the coils.

The foregoing, and other objects, features and advantages of the invention will be apparent from the following more particular description of a preferred embodiment of the invention as illustrated in the accompanying drawings.

BRIEF DESCRIPTION OF THE DRAWINGS

FIG. 1 is a top view of a guitar utilizing the pickup system of a preferred embodiment of the invention.

FIG. 2 is a top view of a pickup coil of the type which may be utilized with this invention.

FIG. 3 is a side view of the pickup coil shown in FIG. 2.

FIG. 4 is a schematic diagram of the pickup system of this invention.

DETAILED DESCRIPTION

Referring now to FIG. 1, it is seen that the guitar 10 has a body 12 with a bridge 14 mounted thereon. Neck 16 extends from the rear of body 12 and a fingerboard 18 is mounted on the neck and extends over the rear portion of body 12. A plurality of strings 20 (shown as six in FIG. 1) terminate at one end in pins 22 and are stretched tightly over bridge 14 and over fingerboard 18 terminating at the other end at pegs (not shown) on a peghead.

Pickup coil assembles 24, 26, and 28 are positioned one behind the other on body 12 underneath strings 20. Coil assembly 26 is mounted on a plate 30 which is moveable in a plane parallel to the plane of the strings in a slot 32. The exact manner in which pickup coil 26 is moved relative to pickup coils 24 and 28 does not form part of the present invention and any mechanism suitable for permitting such movement may be utilized. An example of a mechanism suitable for this purpose may be found in U.S. Pat. No. 3,911,777 entitled "Electric Guitar With Slidable Pickup Beneath Strings" issued to Stanley B. Rendell on Oct. 14, 1975, and assigned to the assignee of the present application. Each of the pickup coils 24, 26, and 28 may be raised, lowered, or tilted by operating suitable one or more of the screws 34. Again, while the capability of being able to raise and lower the pickups is a part of this invention, the exact mechanism for performing this function does not form part of the present invention and any one of several known techniques for performing this function may be utilized.

In FIG. 1, the pickup coils are shown as they appear in the final instrument wherein they are positioned within a suitable casing. FIGS. 2 and 3 show a single one of the pickup coils as it would appear with the casing removed for a preferred embodiment. Referring to these figures, it is seen that each pickup coil consists of a coil form 36 of an insulating material having a wire coil 38 of a predetermined number of turns wound thereon in a predetermined direction. The center of the coil form has an opening in which a permanent magnet 40 is positioned. The wire of coil 38 may be wound on coil form 36 either clock wise as illustrated by arrow 42 or counter clockwise as illustrated by arrow 44. Signals induced in a coil, either as a result of string vibration or noise signals generated in response to stray electro magnetic fields, will be of a given phase in a coil wound in direction 42 and will be 180° out of phase with the given phase for a coil wound in direction 44. Thus, if two coils, one wound in direction 42, and one wound in direction 44, are connected in series, signals induced in these coils will be 180° out of phase with each other and will cancel. Noise signals resulting from stray fields may be cancelled in this way.

Side 46 of magnet 40 may be a north pole or a south pole, side 48 of the magnet always being poled opposite to side 46. As will be discussed later, magnet 40 may also be demagnetized (i.e. be merely a nonmagnetized soft iron core) in which event neither side 46 or 48 is poled. If side 46 is a north pole, the signal induced in coil 38 as a result of string vibration will be 180° out of phase with the signal which is induced in this coil as a result of string vibration if side 46 is a south pole. The polarity of magnet 40 does not affect the phase of noise signals resulting from stray electromagnetic fields. Thus, by connecting in series two coils which are both wound in opposite directions and have magnets which are oppositely poled, noise signals are 180° out of phase and thus cancel while signals resulting from string vibration are 360° out of phase, or in other words in phase, and are therefore additive. As will be described in more detail later, the coils of this invention are, for the most part, connected to function in this manner.

Referring again to FIG. 1, it is seen that there are three switches positioned on the lower right-hand side of body 12. Switch 50 is a four position switch, while switch 52 is a two position switch. As will be seen later, each of these switches is also a three pole switch. Switch 54 is a two position toggle switch. The function of each of these switches will be described in the discussion to follow.

Referring now to FIG. 4, it is seen that when switch 52 is in its (1) position, as shown in the figure, a circuit is completed from ground through switch contact 52B, bridge coil 24, and switch contact 52C to channel one output line 56. Thus, with switch 52 in its (1) position, switch 50 is out of the circuit. With switch 52 in this position, a strong treble sound unmuddied by sounds from other pickups is obtained from the bridge pickup 24. However, by using only a single pickup, the advantages of noise signal cancellation is lost.

With switch 50 in its (1) position, and switch 52 in its (2) position, a circuit is completed from ground through switch contact 52B, switch contact 50B, center coil 26, coil 28, switch contact 50C, and switch contact 52C, to channel one output line 56. Thus, with the switches set in this condition, coils 26 and 28, which coils are oppositely poled, are connected in series with current flowing through the coils in opposite directions. From previous discussion, it is apparent that when the coils are connected in this manner, noise signals induced in the coils are out of phase and cancelled while signals induced in the coils as a result of string vibration are in phase, at least for selected frequencies, and are therefore additive. If the two coils were very closely adjacent to each other so that they are effectively sensing the same point on each string, the string-induced signals would be in phase, and thus additive, at all frequencies. However, since these coils are spaced from each other by a predetermined distance, they are sensing different points on each string. Thus, the string-induced signals are fully additive only at frequencies having wave lengths which are integral submultiples of the spacing between the coils. The string-induced signals are out of phase for frequencies having wave lengths which are odd submultiples of half the distance between the coils. At other frequencies, the string-induced signals are partially in phase and partially out of phase. When the coils are relatively close together, fundamental frequencies (i.e. 50 to 200 CPS) are accentuated while if pickup 26 is spaced roughly two inches from pickup 28, mid-range frequencies (1,500 to 2,000 CPS) tend to be out of phase in the two coils and cancel while higher and lower frequencies are partially and/or fully in phase and additive. Other desired effects can be obtained by utilizing different spacings between the coils 26 and 28. In any event, with switch 50 in its (1) position, since the center and rear pickups are being utilized, the sound obtained is heaviest in the bass and mid-range frequencies and weakest in the treble frequencies.

With switch 50 and switch 52 both in their (2) position, a circuit is completed from ground through switch contact 52B, switch contact 50B, center coil 26, bridge coil 24, switch contact 50C and switch contact 52C to the channel one output line 56. This connection functions in the same manner as the connection described above when switch 50 is in position (1) except that, since bridge pickup 24 and pickup 26 are being utilized rather than pickups 26 and 28, the output sound is stronger in treble and mid-range frequencies and weaker in bass frequencies. As with the other configurations, the sound may be further altered by moving center coil 26 closer or further away from coil 24.

With switch 52 in its (2) position and switch 50 in its (3) position, two parallel circuits are completed. The first circuit is from ground through switch contact 52B, switch contact 50B, center coil 26, bridge coil 24, switch contact 50C, and switch contact 52C to the channel 1 output line 56. The second circuit is from ground through contact 52B, contact 50B, coil 26, coil 28, switch contact 50A, switch contact 52A, and line 58 to switch 54. With switch 54 in the position shown, the outputs from both coils 24 and 28 are applied to channel one output line 56. However, if a stereo effect is desired, switch 54 may be transferred, causing the output from coil 28 on line 58 to be passed through switch 54 to channel two output line 60. It is noted that the outputs from coils 24 and 28 will be somewhat different, the output from coil 24 being stronger in the treble frequency range and the output from coil 28 being stronger in the bass frequency range. The differences in outputs from these two coils may be further altered by moving center coil 26 closer to one coil or the other. Thus, with this configuration, all of the advantages achievable by using two separate two coil pickups are achieved utilizing only three coils rather than four and, by making the center pick-up movable, additional variations in the sound output are also obtainable. With coil 26 in its mid-positions, this configuration also offers a stronger mid-range response than the prior art.

With switch 52 in its (2) position and switch 50 in its (4) position, a circuit is completed from ground through contact 52B, contact 50B, coil 28, bridge coil 24, contact 50C, and contact 52C to channel one output line 56. With the coils connected in series in this manner, both coils are both wound in the same direction and poled in the same direction so that cancellation of noise signals is not achieved. However, a sound which is strong in both the bass and treble range with suppression of mid-range frequencies is obtained.

As previously indicated, with switch 52 in its (1) position, a strong treble sound unmuddied by sound from other pickups is obtained from the bridge pickup 24. However, by using only a single pickup, the advantages of noise signal cancellation is lost. A similar output can be obtained, while still achieving noise cancellation, by having both switches 50 and 52 in their (2) position and preventing signal from being induced in center coil 26 as a result of string vibration. This may be accomplished in a number of ways. One way is to adjust the screws 34 for coil 26 so as to lower this pickup to its lowest position. This can achieve only limited results however since it is not normally possible to lower the coil sufficiently to prevent some signal from being induced therein. A second possibility is to not magnetize the core 40 of the coil. With an unmagnetized soft iron core, the coil will react to stray electromagnetic fields, providing the desired noise cancellation, but will not have signals induced therein as a result of string vibration. The same result can be achieved by positioning coil 26 to the right or left of strings 20 rather than under the strings, or by employing a circular coil rather than an elongated coil as a center coil. It is apparent that with this sort of a center coil, a sound which is rich in bass tones can be obtained with switch 50 in its (1) position and switch 52 in its (2) position.

While the invention has been described above in conjunction with a six-string electric guitar, it is apparent that the invention could also be employed with a four-string bass guitar or with other similar stringed musical instruments. Further, while particular switching circuit has been shown for the preferred embodiment of the invention, it is apparent that the exact switching circuit utilized will depend on the specific pickup configurations which are desired with a given instrument. Thus, while the invention has been particularly shown and described above with reference to a preferred embodiment thereof, the foregoing and other variations may be made therein without departing from the spirit and scope of the invention.

What is claimed is:

1. An electronic pickup system for a stringed musical instrument comprising:

first, second and third pickup coils positioned under the strings of the instrument, the coils being oriented one behind the other along the length of the strings, each of said coils being wound in a predetermined direction, and having a selectively poled magnet passing through its center;

a system output including first and second separate output channels; and means for selectively electrically connecting said coils, at least two at a time, to each other and to said output, said connecting means including means for connecting said first, and second coils and means for connecting said third and second coils, both in a manner such that signals induced in the two coils as a result of string vibration are in phase for at least selected frequencies and additive while noise signals induced in the coils are out of phase and cancel;

means for connecting the output from the first coil to the first channel, and means for selectively connecting the output from the third coil to either the first channel or the second channel.

2. A system as claimed in claim 1 wherein said means for selectively electrically connecting includes a four position switch, means operative when said switch is in each of three different ones of said positions for connecting a different pair of said coils in a manner such that signals induced in said coils as a result of string vibrators are in phase at at least selected frequencies and are thus additive.

3. A system as claimed in claim 2 wherein said means for selectively electrically connecting includes means operative when said switch is in its fourth position for connecting each of the outer coils to the center coil in a manner such that signals induced in each outer coil and the center coil as a result of string vibrator are in phase at at least selected frequencies and are thus additive while noise signals induced in each outer coil and the center coil are out of phase and thus cancel.

4. An electrical pickup system for a musical instrument having a plurality of strings, comprising:

a plurality of pickup coils, each having a magnetic core producing a magnetic field and positioned with respect to at least one of said plurality of strings to be substantially affected by vibrations thereof, electrical signals being induced in said coils in response to the string vibrations;

another coil located in proximity to said plurality of pickup coils and having a winding direction opposite to that of each of the plurality of pickup coils;

output means;

means for connecting each of the plurality of pickup coils with the other coil and in parallel circuit with one another between the other coil and the output means, signals induced in said other coil by noise being out of phase with respect to the signals induced by noise in the plurality of pickup coils for cancelling the noise signals induced in all of said plurality of pickup coils.

5. The electrical pickup system of claim 4 in which the other coil has a core with high magnetic permeability.

6. The electrical pickup system of claim 5 in which the magnetic core of the other coil is a permanent magnet.

7. The electrical pickup system of claim 6 in which the other coil is a pickup coil substantially identical to said plurality of pickup coils, said other pickup coil being positioned with respect to said one string to be substantially affected by vibrations thereof, electrical signals being induced in said other pickup coil in response to said string vibrations.

8. The electrical pickup system of claim 7 in which the magnetic cores of said plurality of pickup coils have a polarity opposite to that of said other pickup coil, signals induced as a result of string vibration in the other pickup coil and each of the plurality of pickup coils connected therewith being in phase and additive for at least selected frequencies.

9. The electrical pickup system means of claim 4 in which said output means includes a pair of separate output terminals, at least one of said plurality of pickup coils is connected between the other coil and one of said pair of output terminals, and at least one other of said plurality of pickup coils is connected between the other pickup coil and the other of said pair of output terminals.

10. The electrical pickup system of claim 9 including means for selectively connecting together the pair of output terminals.

11. The electrical pickup system of claim 4 including means for selectively disconnecting one of said plurality of pickup coils from the output means.

12. An electrical pickup system for a musical instrument having a plurality of strings, comprising:

a plurality of pickup coils spaced from one another along the length of said strings, vibration signals being induced in said pickup coils in response to vibrations of said strings:

means for mounting at least one of said coils for movement along its entire length in a single direction parallel to said strings, the movement of said coil selectively changing the spacing between at least two of said plurality of coils to selectively change the phase relationship of the respective vibration signals induced therein at least some frequencies thereof; and means for combining the vibration signals of the plurality of pickup coils to form a composite output signal, said output signal having a frequency response characteristic variable in accordance with the selected spacing of said pickup coils.

13. The electrical pickup system of claim 12 in which said combining means combines said vibration signals electrically, the portion of the output signals having frequencies at which said respective vibration signals are in phase being emphasized in the composite output signal and the portion of the output signals having frequencies at which the respective vibration signals are out of phase with one another canceling one another and being de-emphasized in the composite output signal.

14. The electrical pickup system of claim 13 in which the frequencies at which the respective vibration signals from a pair of said pickup coils are in phase decreases as the spacing between the pair of pickup coils decreases while the frequencies at which the respective signals from the pairs of pickup coils are out of phase increases.

15. The electrical pickup system of claim 12 in which said plurality of pickup coils comprises a central pickup coil and two outer pickup coils on opposite sides thereof and said center coil is mounted for movement relative to the two outer coils, movement of said center coil toward one of said two outer coils being movement away from the other of said two outer coils.

16. The electrical pickup system of claim 12 including means for selectively changing the spacing of one of said pickup coils from the strings to selectively change the effect of the vibration signal induced therein upon the frequency response characteristic of the composite output signal.

17. The electrical pickup system of claim 12 in which said musical instrument has a bridge, movement of said coil mounted for movement, changing the distance between said coil and the bridge.

* * * * *